US008028553B2

(12) United States Patent
Lange

(10) Patent No.: US 8,028,553 B2
(45) Date of Patent: Oct. 4, 2011

(54) MODULAR ELECTROMECHANICAL LOCK CYLINDER

(75) Inventor: Volker Lange, Quickborn (DE)

(73) Assignee: ASSA Abloy AB, Stockholm (SE)

( * ) Notice: Subject to any disclaimer, the term of this patent is extended or adjusted under 35 U.S.C. 154(b) by 968 days.

(21) Appl. No.: 11/424,437

(22) Filed: Jun. 15, 2006

(65) Prior Publication Data

US 2008/0216530 A1 Sep. 11, 2008

(30) Foreign Application Priority Data

Jun. 24, 2005 (EP) ..... 05013641

(51) Int. Cl.
*E05B 47/00* (2006.01)

(52) U.S. Cl. ..... 70/277; 70/218; 70/278.1; 70/278.7; 70/279.1; 292/336.3; 292/347

(58) Field of Classification Search ..... 70/278.3, 70/278.7, 283, 283.1, 223, 277, 279.1, 149, 70/188, 189, 218, 278.1, 278.2, 472; 340/5.2, 340/5.52, 5.54, 5.61, 5.7; 292/336.3, 347
See application file for complete search history.

(56) References Cited

U.S. PATENT DOCUMENTS

| | | | | |
|---|---|---|---|---|
| 3,009,349 | A | | 11/1961 | Check |
| 3,713,311 | A | | 1/1973 | Oliver et al. |
| 4,073,527 | A | | 2/1978 | Schlage |
| 4,123,926 | A | | 11/1978 | Elder |
| 4,386,510 | A | | 6/1983 | Best et al. |
| 4,810,014 | A | | 3/1989 | McGourty et al. |
| 4,832,385 | A | | 5/1989 | Llort |
| 4,856,310 | A | * | 8/1989 | Parienti ..... 70/379 R |
| 4,901,545 | A | | 2/1990 | Bacon et al. |
| 4,939,915 | A | | 7/1990 | Vonlanthen |
| 4,953,373 | A | | 9/1990 | Toledano |
| 5,010,750 | A | | 4/1991 | Boser et al. |
| 5,027,629 | A | | 7/1991 | Liu |

(Continued)

FOREIGN PATENT DOCUMENTS

DE 19525196 1/1997

(Continued)

OTHER PUBLICATIONS

Official Action for U.S. Appl. No. 11/534,518, mailed May 16, 2007.

(Continued)

*Primary Examiner* — Lloyd Gall
(74) *Attorney, Agent, or Firm* — Sheridan Ross P.C.

(57) ABSTRACT

A lock cylinder with a lock cylinder housing is provided. A knob shaft, rotatable by way of a knob, is mounted to rotate on one side or both sides of the lock cylinder. An authorization signal causes at least one electromechanically operating coupling device to connect a lock element to rotate in unison with the knob shaft and in order to operate a lock. The authorization signal is generated by evaluation electronics based on an input or input signal. It is proposed that at least one reading unit with an input unit to record the input and/or a receiving unit to receive the input signal is present, that the reading unit with the input unit and/or receiving unit is arranged in at least one knob and are spatially separated from the evaluation electronics, that the knob is connected electrically and mechanically releasable to the knob shaft, and that the reading unit generates, from the input or input signal, an access signal that can be evaluated by the evaluation electronics.

14 Claims, 1 Drawing Sheet

U.S. PATENT DOCUMENTS

Figure 1:
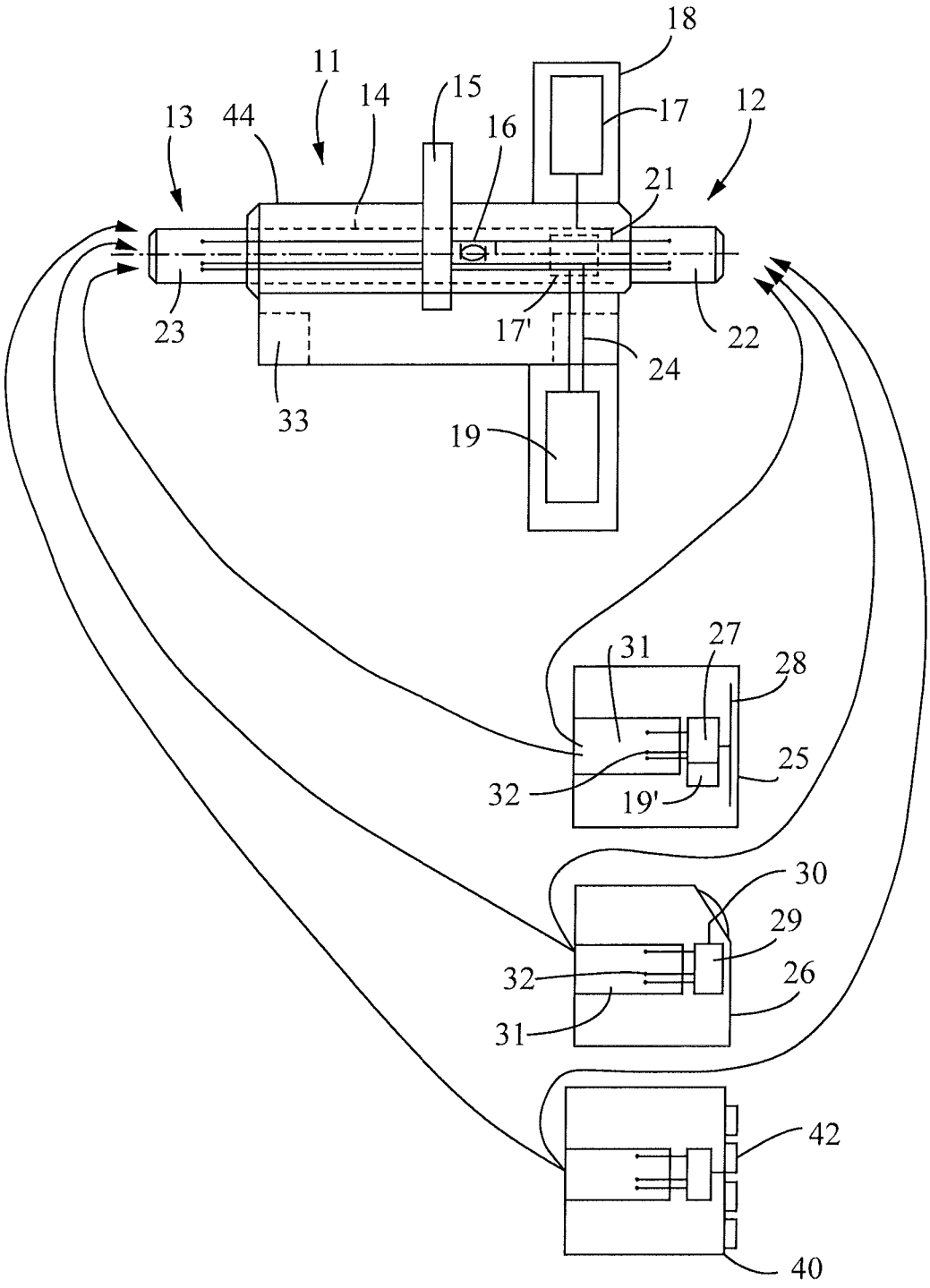

| | | | | |
|---|---|---|---|---|
| 5,542,274 | A | 8/1996 | Thordmark et al. | |
| 5,628,217 | A | 5/1997 | Herrera | |
| 5,791,177 | A * | 8/1998 | Bianco | 70/283.1 |
| 5,826,450 | A | 10/1998 | Lerchner et al. | |
| 5,839,305 | A | 11/1998 | Aston | |
| 5,848,541 | A | 12/1998 | Glick et al. | |
| 5,946,956 | A * | 9/1999 | Hotzl | 70/276 |
| 6,079,238 | A | 6/2000 | Hoffmann et al. | |
| 6,079,240 | A | 6/2000 | Shvarts | |
| 6,101,856 | A | 8/2000 | Pelletier et al. | |
| 6,158,259 | A | 12/2000 | Schmitz et al. | |
| 6,264,256 | B1 | 7/2001 | Hankel et al. | |
| 6,286,347 | B1 | 9/2001 | Frolov | |
| 6,301,942 | B1 | 10/2001 | Shvarts | |
| 6,334,347 | B1 | 1/2002 | Iscla | |
| 6,374,653 | B1 | 4/2002 | Gokcebay et al. | |
| 6,384,711 | B1 * | 5/2002 | Cregger et al. | 340/5.65 |
| 6,474,122 | B2 | 11/2002 | Davis | |
| 6,487,884 | B1 | 12/2002 | Constantinou | |
| 6,523,377 | B1 | 2/2003 | Vonlanthen | |
| 6,526,791 | B2 | 3/2003 | Shvarts | |
| 6,564,600 | B1 | 5/2003 | Davis | |
| 6,564,601 | B2 | 5/2003 | Hyatt, Jr. | |
| 6,578,396 | B2 | 6/2003 | Field et al. | |
| 6,604,394 | B2 | 8/2003 | Davis | |
| 6,615,625 | B2 | 9/2003 | Davis | |
| 6,640,594 | B1 | 11/2003 | Yao | |
| 6,651,468 | B2 | 11/2003 | Aramburu et al. | |
| 6,718,806 | B2 | 4/2004 | Davis | |
| 6,725,693 | B2 | 4/2004 | Yu et al. | |
| 6,826,935 | B2 | 12/2004 | Gokcebay et al. | |
| 6,840,072 | B2 | 1/2005 | Russell et al. | |
| 6,865,916 | B2 * | 3/2005 | Goldman | 70/472 |
| 6,895,792 | B2 | 5/2005 | Davis | |
| 7,193,503 | B2 * | 3/2007 | Fisher | 340/5.73 |
| 7,275,402 | B2 * | 10/2007 | Luling et al. | 70/472 |
| 2002/0187307 | A1 | 12/2002 | Tanaka et al. | |
| 2003/0200778 | A1 * | 10/2003 | Chhatwal | 70/408 |
| 2004/0040355 | A1 | 3/2004 | Goldman | |
| 2004/0159135 | A1 * | 8/2004 | Kato et al. | 70/278.3 |
| 2005/0265796 | A1 | 12/2005 | Persson | |
| 2006/0213240 | A1 | 9/2006 | Krisch et al. | |
| 2008/0072636 | A1 | 3/2008 | Padilla | |
| 2008/0072637 | A1 | 3/2008 | Padilla | |
| 2008/0229793 | A1 | 9/2008 | Lange | |

FOREIGN PATENT DOCUMENTS

| | | |
|---|---|---|
| DE | 29703559 | 4/1997 |
| DE | 19603320 | 8/1997 |
| DE | 19851308 | 5/1999 |
| DE | 19822865 | 11/1999 |
| DE | 19919283 | 12/1999 |
| DE | 19854879 | 8/2000 |
| DE | 19930054 | 1/2001 |
| DE | 10100787 | 7/2002 |
| DE | 10163355 | 3/2003 |
| DE | 10225368 | 7/2003 |
| DE | 10328297 | 1/2005 |
| EP | 0243586 | 11/1987 |
| EP | 0453878 | 10/1991 |
| EP | 0899399 | 3/1999 |
| EP | 0924369 | 6/1999 |
| EP | 1022415 | 7/2000 |
| EP | 1065335 | 1/2001 |
| EP | 1079051 | 2/2001 |
| EP | 1174572 | 1/2002 |
| EP | 1256671 | 11/2002 |
| EP | 1378620 | 1/2004 |
| EP | 1679414 | 7/2006 |
| WO | WO 02/088492 | 11/2002 |
| WO | WO 03/097970 | 11/2003 |
| WO | WO 2005/001224 | 1/2005 |

OTHER PUBLICATIONS

Official Action for U.S. Appl. No. 11/424,436, mailed Oct. 24, 2008.
Official Action for U.S. Appl. No. 11/534,518, mailed Sep. 5, 2008.
Official Action for U.S. Appl. No. 10/562,166, mailed Dec. 26, 2007.
Official Action for U.S. Appl. No. 11/534,518, mailed Oct. 10, 2007.
Official Action for U.S. Appl. No. 11/534,518, mailed Feb. 11, 2008.
European Search Report for European Patent Application No. 05013641.5, dated Dec. 6, 2005.
Examination Report for European Patent Application No. 05013641.5, dated Nov. 19, 2007.
Computer Generated Translation of WO 02/088492 A2, European Patent Office Website, http://gb.espacenet.com/search97cgi/s97_cgi.exe? Action=FormGen& Tem plate=gb/EN/home.hts.
Official Action for U.S. Appl. No. 11/534,518, mailed Feb. 20, 2009.
Official Action for U.S. Appl. No. 10/562,166, mailed Feb. 19, 2009.
Official Action for U.S. Appl. No. 11/534,509, mailed Apr. 18, 2007.
Official Action for U.S. Appl. No. 11/534,509, mailed Nov. 1, 2007.
Official Action for U.S. Appl. No. 10/562,166, mailed Sep. 2, 2009.
Official Action for U.S. Appl. No. 11/424,436, mailed Nov. 24, 2009.
Notice of Allowance for U.S. Appl. No. 11/534,518, mailed Mar. 19, 2010.
Official Action for U.S. Appl. No. 11/534,209, mailed May 1, 2008.

* cited by examiner

MODULAR ELECTROMECHANICAL LOCK CYLINDER

BACKGROUND OF THE INVENTION

The invention concerns a lock cylinder with a lock cylinder housing, in which a knob shaft, rotatable by means of a knob, is mounted to rotate on one side or both sides, and with at least one electromechanically operating coupling device, which is connected to rotate in unison with the knob shaft based on a authorization signal of a lock element and/or releases the knob shaft, in order to operate a lock, said connection signal being generated by an evaluation electronics based on an input or input signal. As an alternative, the lock element of the lock cylinder can be operated on one side or both sides by a lock core, rotatable by means of a key. The invention also concerns a lock cylinder that can be operated on one side with a knob and on the other side with a key.

The lock cylinder, operable on one side, can be designed as a half-cylinder. In a lock cylinder operable on both sides a lock core or knob shaft can be connected or connectable purely mechanically always to the lock element. A purely mechanically operating knob with an electromechanical operating lock core can then be combined in a lock cylinder and vice versa.

Such lock cylinders are generally known. A frequent arrangement is that the input signal is recorded by means of an antenna, which excites a transponder in a key, a chip or a similar token, worn by the person granted access. The received input signal contains the access code, which is evaluated by the evaluation electronics. In the case of access authorization, an authorization signal is generated, which drives an electromechanical coupling device. The coupling device causes rotation-free connection between the lock element, for example, the lock tab, and the knob or key, or releases the knob shaft or the lock core. Activation of the lock or a switch or the like is then possible with the lock cylinder.

DE 199 30 054 A1 describes an electromechanical lock cylinder, which can be operated on one side with a key and on the other side with a knob. The specific arrangement is such that the key carries a transponder, whose signal is received via an antenna on the lock cylinder housing and evaluated by evaluation electronics in the knob. DE 198 51 308 C2 discloses a lock cylinder that can be operated on both sides by a knob. The evaluation electronics and the antenna to receive a signal transmitted in wireless fashion are arranged in the knob on the inside of the door. It is known from EP 1 256 671 A2 to arrange the evaluation electronics in a rosette.

A common feature of all known variants of electromechanical lock cylinders is that the evaluation electronics, the antenna and the coupling device, in particular, form a unit with respect to data flow and the signals being transmitted, which cannot be separated from each other. This means that for different reading systems or recording systems or different data transmission techniques between the token and lock cylinder with different cylinders and/or frequencies and/or ranges, a complete lock cylinder with evaluation electronics adapted to the recording system must always be produced and kept on hand. The same applies for other types of input, for example, the provision of a biometric sensor, a keypad or simple pushbutton in internal knobs. Here again, depending on the choice of the desired operating release, a complete lock cylinder with correspondingly adapted evaluation electronics must be kept on hand. If the technology for input or recording of the access code changes, the evaluation electronics must be adapted to it. It is obvious that high production, development and storage costs are required for this.

BRIEF SUMMARY OF THE INVENTION

The underlying task of the invention is to design a lock cylinder of the type just outlined, so that flexible production and preparation of a lock cylinder are possible.

The task is solved in a lock cylinder, operable by at least one knob according to the invention, in that at least one reading unit with an input unit to record the input and/or a receiving unit to receive the input signal is present, that the reading unit with the input and/or receiving unit is arranged spatially separated from the evaluation electronics and at least one knob, that the knob is electrically or mechanically connected in releasable fashion to the knob shaft, and that the reading unit generates, from the input or input signal, an access signal that can be evaluated by the evaluation electronics.

In a lock cylinder operable by at least one key, it is prescribed to solve the task that at least one reading unit with an input unit to record the input and/or receiving unit to receive the input signal is present, that the reading unit with the input and/or receiving unit is arranged spatially separated from the evaluation electronics in a component, which is mounted electrically and mechanically in releasable fashion in or on the cylinder housing, and that the reading unit generates, from the input or input signal, an access signal that can be evaluated by the evaluation electronics.

In a lock cylinder that is operable from one side by a knob and from the other side by a key, the task is solved by the fact that a first and a second reading unit, each with an input unit to record the input and/or a receiving unit to receive the input signal, are present, that the first reading unit with the input and/or receiving unit is arranged spatially separated from the evaluation electronics in the knob, which is electrically or mechanically connected to the knob shaft in releasable fashion, that the second reading unit with the input or receiving unit is arranged spatially separated from the evaluation electronics in a component that can be mounted electrically and mechanically in or on the cylinder housing in releasable fashion, and that the reading units each generate, from the input or input signal, an access signal that can be evaluated by the evaluation electronics.

If the reading unit cooperates with a key that fits the lock core, the input signal is often transmitted from the key to the reading unit. If the reading unit is arranged in the knob, the input signal is often transmitted from a token, like a keychain or chip card.

Separation of the reading unit from the evaluation unit has the advantage that the same evaluation electronics can always be used. Preferably, a standardized access signal is generated by the reading unit. However, it can also be prescribed that the evaluation electronics be programmable for evaluation of different access signals. The assembly comprising the evaluation electronics and the lock cylinder housing with the coupling device can also always remain the same, regardless of the type of generation and recording of the input signal. A replacement of data transmission systems optimized and technically adapted to the surrounding conditions or a change to different types of input is possible without difficulty.

The knob or the component that carries the reading unit is disassembled for this purpose and the required signal lines for the access signal and the lines for the power supply of the reading unit, if necessary, are separated. A knob or component with a different reading unit is reinserted in the opposite sequence. In this context, it is favorable, and especially self-evident that the access signal generated by the reading unit does not lead easily to the authorization signal. Instead, it must be avoided that by installing a knob from a first lock cylinder on another lock cylinder, this would also be opened.

For this purpose, it can be prescribed that the reading unit transmit an identification code with the access signal. It can also be prescribed that an identification code, during installation of a reading unit, must be transmitted or must be called up by the evaluation electronics. Because of the identification code, the reading unit is clearly allocated to specific evaluation electronics and therefore a specific lock cylinder. Only when the identification code, on the one hand, and the access signal, on the other, agree, is the authorization signal generated. Simple replacement of reading units for unauthorized operation of locks is therefore prevented.

The type of reading unit and the type of optionally present sensors or antenna can therefore be arbitrary. The reading unit can thus have an antenna to record an input signal transmitted in wireless fashion. The antenna is preferably a component of a transponder system and serves to excite the passive transponder in the token.

It is also possible that the reading unit has a biometric sensor to scan at least one biometric feature. The reading unit can also have at least one electronic contact, via which the input signal is transmitted. The electrical contact, for example, can be a contact sensor. The reading unit can also have a keypad, via which input occurs. The access signal generated in this case always has a dataset with an access code that can be evaluated by the evaluation electronics and is recognized as admissible or not.

Finally, it is possible that the reading unit is a pushbutton. Here again, an access signal and possibly an identification code with a dataset can be generated by operating the button, which only leads to release when this dataset is entered as admissible in the evaluation electronics. Misuse by simple replacement of knobs, in which a coded input or receipt of coded signals is required, with a knob that carries a pushbutton is therefore not possible.

In each case, it is expedient if preprocessing of the received input signal or input occurs in the reading unit. In particular, processing of the biometric feature can occur in evaluable datasets. An access signal can therefore be generated that can be directly evaluated in the evaluation electronics to generate the authorization signal. The evaluation electronics can then be tuned to the access control, while processing of the entered data in carried out in the reading unit. The advantage of separation of these assemblies is particularly apparent here.

DETAILED DESCRIPTION OF THE INVENTION

The lock cylinder and its components are preferably constructed in modular fashion. It can be prescribed that the lock cylinder housing be designed to accommodate a knob shaft or a lock core on one side or both sides. It can also be expedient, if the lock cylinder housing has space on both sides for installation of the component. A situation is therefore achieved, in which the base element can always be produced in the same way. Different installation lengths can therefore be produced by known spacers or intermediate pieces between the opposite receptacles for the lock core or knob shaft.

If no component need be mounted with the reading unit in the lock cylinder housing on one or the other side, since, for example, a knob or purely mechanical lock core is provided there, a blind cap can be provided that closes the space. The housing and the evaluation electronics can therefore be the same for a number of lock cylinders. The manufacturing expense and stock keeping are simplified. Above all, it is not necessary, during a change in the type of input, to change the entire evaluation electronics. The adjustment occurs in the reading unit.

The reading unit and the evaluation electronics are supplied with power by a power supply independent of line voltage. If data signals or power currents are to be transmitted between assemblies that are movable relative to each other, slip ring contacts are suitable. The slip rings preferably lie in the interior of the lock cylinder housing, so that the contact surfaces are not accessible from the outside or are not exposed during replacement of the knob. Signal and data transmission can occur via an additional line, which also comprises a slip ring contact between the rotatable assemblies. Here again, the advantage of the invention is apparent. It is no longer necessary to transmit a sensitive antenna signal in the lock cylinder to the evaluation electronics, which poses problems with respect to shielding. Instead, this signal can be converted and/or amplified by the reading unit, for example, to a digital signal. Simpler, better and more reliable data transmission is therefore possible.

It can be expedient, if the reading unit in the knob is supplied by a separate power supply in the same knob or the opposite knob. It can also be prescribed that the reading unit be supplied in a releasable component by a separate power supply in the lock cylinder housing and/or in the component. The power supply can then be tuned to the reading unit. The power supply for the evaluation electronics can also be designed correspondingly smaller. By this distribution of assemblies and power supplies, the limited space in such lock cylinders can be better utilized.

In principle, it is arbitrary where the evaluation electronics are accommodated in or on the lock cylinder. It can be prescribed that the evaluation electronics be arranged in the lock cylinder housing. However, it can also be favorable, if the evaluation electronics are arranged in at least one rosette arranged on one side of the lock cylinder. It can then also be prescribed that the power supply to supply the evaluation electronics and/or the reading unit(s) also be arranged in the rosette. A rosette offers sufficient space for a number of electronic components. It is possible, in particular, to protect the rosette properly from external weather effects or to use high-power power supplies with higher capacity and lifetime, like batteries. A lock cylinder equipped in this way can then also be used in the outdoor area or for doors that are used frequently.

The evaluation electronics can also be arranged in the knob shaft. This is readily possible by miniaturization of the electronic components. It can also be favorable, if the power supply to supply the evaluation electronics and/or the reading unit(s) is also arranged in a knob. A situation is then achieved in which all electronic elements sit on one component. No data transmission between oppositely movable parts is required, so that the operational reliability is increased.

The invention is further explained below by means of a schematic drawing, whose single FIGURE shows a double-knob cylinder with knob shafts for different knobs.

The lock cylinder 11 depicted in the drawing is designed as a so-called double-knob cylinder, which can be operated from both sides 12, 13 with a knob. A knob shaft 14 is mounted to rotate in the lock cylinder housing 44, on which a lock tab 15 is mounted to rotate. A coupling device 16, merely depicted schematically, is present, so that rotation-proof connection between the lock tab and the knob shaft is produced when it is driven by an authorization signal. The power supply lines and the logic unit to drive the coupling device are not shown in the drawing. The coupling device, for example, can be an electric motor with an eccentric gear mechanism, an electromagnetic drive or a rotary magnet.

Evaluation electronics 17 are present to produce the authorization signals, which are arranged in a rosette 18 mounted on one side 12 of the lock cylinder. The evaluation electronics are electrically connected to a power supply 19 and the coupling device 16. Alternatively, the evaluation electronics 17' may be located in the knob shaft.

The evaluation electronics cooperate with a reading unit, which is accommodated with a sensor and a knob. The arrangement in detail is such that the evaluation electronics have a signal transmission connection 21 that extends to the shaft ends 22, 23 via slip ring contacts (not shown). Alternatively, a power supply 19' may be located in the knob.

Three different knobs 25, 26 and 40 are shown in the drawing, each of which fit on one of the shaft ends 22, 23. The knob 25 includes a reading unit 27 with an antenna 28 of a transponder system. Knob 26 includes a reading unit 29 with a biometric sensor 30. Knob 40 includes a keypad or touch pad 42. The reading units are designed, so that from the recorded input signals, namely, a radio signal, biometric data or manually entered data generate an access signal which contains an access code that can be evaluated by the evaluation electronics 17.

The knobs 25, 26 each have a hub 31, which fits on the shaft ends 22, 23, and via which the knobs can be connected to rotate in unison with the knob shaft. Axial fastening against pulling off during normal use is also provided. The electrical connections 32 in the knob are designed corresponding to the signal transmission connection 21 and the power supply lines 24. Each knob 25, 26 can therefore be arbitrarily positioned on the double-knob cylinder.

It can be prescribed that a communication unit is additionally or, as an alternative, arranged in a knob, which is connected to the evaluation electronics. The lock cylinder can be programmed or connected to a network via the communication unit. The communication unit, for this purpose, can have an arbitrarily designed interface, and especially a radio or infrared interface. A wired interface or contact plug can also be provided. The communication unit can be assigned to specific evaluation electronics, like the reading unit, via an identification code.

In a lock cylinder with lock core, a lock core operable with a key is provided instead of the knob shaft. The reading unit here can be arranged, for example, with an antenna, for readout of a transponder in the key in a component 33 in the front end of the lock cylinder. This is shown in the drawing with dashed lines. A signal connection and the power supply occur via lines in a fixed housing part. In principle, a lock cylinder housing can be designed both for key operation and knob operation. The slip rings for the knob shaft can then be arranged in the front area, in which the component for the reading unit for the transponder for the key is otherwise positioned. They are readily accessible there for assembly and can be covered by a correspondingly designed blind cap.

A lock cylinder with modular design is therefore furnished, which can be expanded and retrofitted almost arbitrarily. It is merely necessary to develop the knob with the reading unit and the sensor corresponding to the designed type of input of the access code and provide it with corresponding mechanical and electronic interfaces. Then, any knob can be mounted on any lock cylinder housing with the same evaluation electronics.

What is claimed is:

1. A lock cylinder with a lock cylinder housing, a knob shaft rotatable by means of a knob wherein the knob is attached to the knob shaft, the knob shaft mounted to rotate on one side or both sides of the lock cylinder, at least one electromechanically operating coupling device, which, based on an authorization signal, connects a lock element to rotate in unison with the knob shaft in order to operate a lock, the authorization signal being produced by an evaluation electronics based on an input signal, the evaluation electronics positioned in the knob shaft, at least one reading unit with a receiving unit to receive the input signal, the at least one reading unit with the receiving unit is arranged spatially separated from the evaluation electronics in the knob, the knob is connected electrically and mechanically releasable to the knob shaft, and the reading unit produces, from the input signal, an access signal that can be evaluated by the evaluation electronics.

2. The lock cylinder according to claim 1 wherein the receiving unit comprises an antenna to receive an input signal transmitted in wireless fashion.

3. The lock cylinder according to claim 1, wherein the unit has at least one electrical contact, via which the input signal is transmitted.

4. The lock cylinder according to claim 1, wherein the reading unit is assigned to the evaluation electronics by an identification code.

5. The lock cylinder according to claim 4, wherein the identification code is transmitted with the access signal to the evaluation electronics or queried by the evaluation electronics.

6. The lock cylinder according to claim 1, further comprising a power supply to supply power to at least one of the evaluation electronics or the reading unit(s).

7. The lock cylinder according to claim 1, wherein the knob is fastened to the knob shaft such that the knob cannot separate from the knob shaft in normal use.

8. The lock cylinder according to claim 1, wherein the knob further comprises a hub to receive the knob shaft.

9. The lock cylinder according to claim 8, wherein the knob shaft is received within the knob.

10. The lock cylinder according to claim 1, wherein the input signal is not stored in the knob.

11. The lock cylinder according to claim 1, further comprising an input unit associated with the reading unit to receive input and generate the input signal.

12. The lock cylinder according to claim 11, wherein the input unit comprises a biometric sensor to scan at least one biometric feature.

13. The lock cylinder according to claim 11, wherein the input unit comprises a pushbutton.

14. The lock cylinder according to claim 11, wherein the input unit has a keypad, via which input occurs.

* * * * *